US005964615A

United States Patent [19]

Endres

[11] Patent Number: 5,964,615

[45] Date of Patent: Oct. 12, 1999

[54] SNAP-IN LAMPHOLDER WITH INSULATION DISPLACEMENT CONTACTS

[75] Inventor: Paul Endres, Plainview, N.Y.

[73] Assignee: Leviton Manufacturing Co., Inc., Little Neck, N.Y.

[21] Appl. No.: 09/001,711

[22] Filed: Dec. 31, 1997

[51] Int. Cl.[6] ..... H01R 4/24

[52] U.S. Cl. ..... 439/419; 439/558

[58] Field of Search ..... 439/339, 340, 439/357, 404, 417, 419, 558

[56] References Cited

U.S. PATENT DOCUMENTS

| | | | |
|---|---|---|---|
| Re. 34,135 | 12/1992 | Madsen et al. | 439/419 X |
| 2,636,069 | 4/1953 | Gilbert | 439/419 X |
| 3,950,066 | 4/1976 | Bienwald | 439/558 |
| 5,446,640 | 8/1995 | Lin | 439/419 |
| 5,795,179 | 8/1998 | Lin | 439/441 |
| 5,800,183 | 9/1998 | Paul et al. | 439/56 |

*Primary Examiner*—Khiem Nguyen
*Attorney, Agent, or Firm*—Paul J. Sutton

[57] ABSTRACT

A snap-in lampholder with insulation displacing contacts which can be attached to the end or midspan of a two conductor electrical cord. The lampholder portion has a main body which contains a screwshell portion and a contact portion. The contacts extend into the screwshell portion to engage the screwshell and center base contact of an inserted lamp. A cap is depressed to force the individual conductors into associated ID contacts and to lock the cap to the contact portion. The entire assembly can then be mounted to a mounting can or panel which in turn can be mounted upon a mounting surface.

13 Claims, 8 Drawing Sheets

SNAP-IN LAMPHOLDER WITH INSULATION DISPLACEMENT CONTACTS

BACKGROUND OF THE INVENTION

1. Field of the Invention

The invention deals with electric lampholders, and more particularly, with a lampholder having insulation displacement contacts (IDC) and which can be snapped into and supported by a mounting cup mechanically coupled to a support member or directly coupled to a panel.

2. Description of the Prior Art

According to prior art techniques, a ceiling or wall mounted lampholder was installed as follows: The conductors to which the lampholder was to be coupled had to have their ends bared and led to the lampholder to be attached thereto by terminal screws while the full weight of the lampholder, any fixture or reflector was supported adjacent the ceiling or wall. Fasteners were then installed between the lampholder, fixture or reflector and a mounting plate in the ceiling or wall. It is an object of this invention to provide a novel lampholder assembly.

It is an object of this invention to provide a novel lampholder assembly which can be installed more quickly and with greater ease.

It is another object of this invention to provide a novel lampholder assembly which employs insulation displacement contacts (IDC) that eliminate the step of stripping the insulation from the ends of the electrical conductors.

It is yet another object of this invention to provide a novel lampholder assembly which employs IDCs to eliminate the stripping of the ends of the electrical conductors coupled to such lampholder and makes electrical and mechanical contact therewith.

It is another object of this invention to provide a lampholder and a reflector which can be joined after the lampholder has been wired in the circuit.

It is yet another object of this invention to provide a lampholder and mounting which can be joined by the use of snap-in devices.

Other objects and features of the invention will be pointed out in the following description and claims and illustrated in the accompanying drawings, which, disclose, by way of example, the principles of the invention, and the best mode which is presently contemplated for carrying them out.

SUMMARY OF THE INVENTION

A lampholder has insulation displacement contacts to receive and engage electrical conductors, mechanically and electrically, when a snap-on cover is applied over the exposed IDCs and conductors. The lampholder can thereafter be snapped into a mounting can, reflector or panel and the entire assembly mounted to a surface, such as a ceiling or wall, by the use of fasteners applied from said can, reflector or panel to a mounting surface.

BRIEF DESCRIPTION OF THE DRAWINGS

In the drawings in which similar elements are given similar reference characters.

DESCRIPTION OF THE PREFERRED EMBODIMENT

Figure 10:
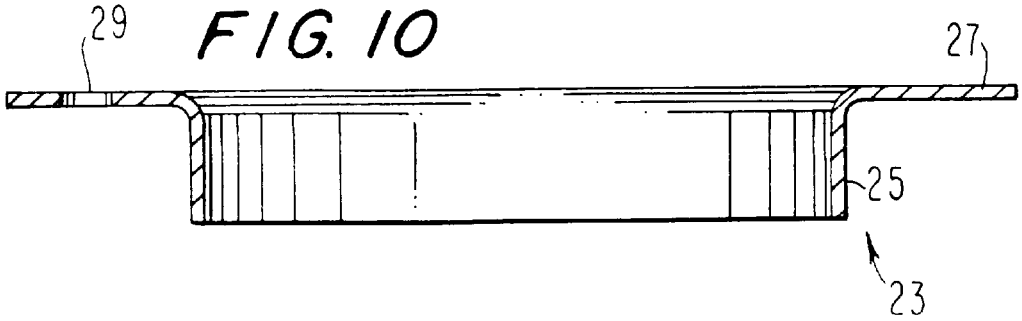
FIG. 10 is a side elevational view, in section, of the mounting flange for the snap-in lampholder assembly of FIG. 1.

Turning now to FIGS. 1 to 4 and 10, there is shown a snap-in lampholder assembly 20 comprising a mounting cup 22 which can also act as a reflector. The bottom of cup 22 is open to permit lamps (not shown) to be placed in or removed from the lampholder portion. The interior surface of the cup 22 (not shown) can be made reflective if the cup 22 is to serve as a reflector or finished in a matte finish if it is not. The top surface 26 of mounting cup 22 has slots 24 therein to act as vents and permit the hot air in the interior of the cup 22 to escape. To mount cup 22 to a gang box, reflector or mounting surface, a circular mounting flange 23, as shown in FIG. 10, is used. Circular mounting flange 23 has a circular wall 25 which surrounds the cup 22 adjacent to top surface 26 and is riveted, spot welded, dimpled, etc. to the exterior of cup 22. The height of circular wall 25 and the point at which the flange 23 is joined to cup 22 is selected in accordance with the needs of the individual application. A second circular member 27 extends at right angles to circular wall 25 and contains two or more mounting holes 29 to receive mounting fasteners (not shown). Top surface 26 has a central circular aperture 28 with two opposed key slots 30.

Figure 7:
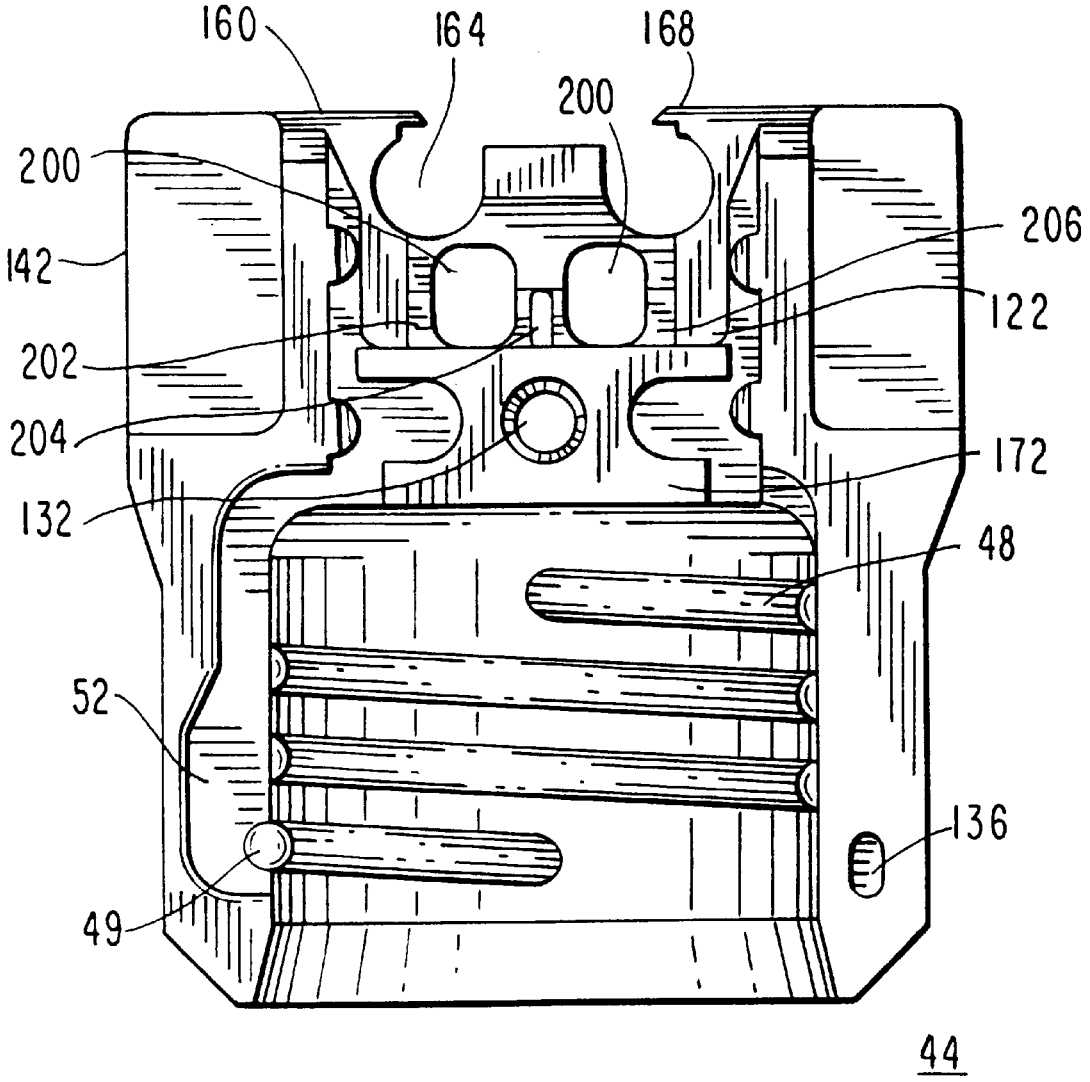
FIG. 7 is a front elevational view of one of the halves of the lampholder portion.
Figure 8:
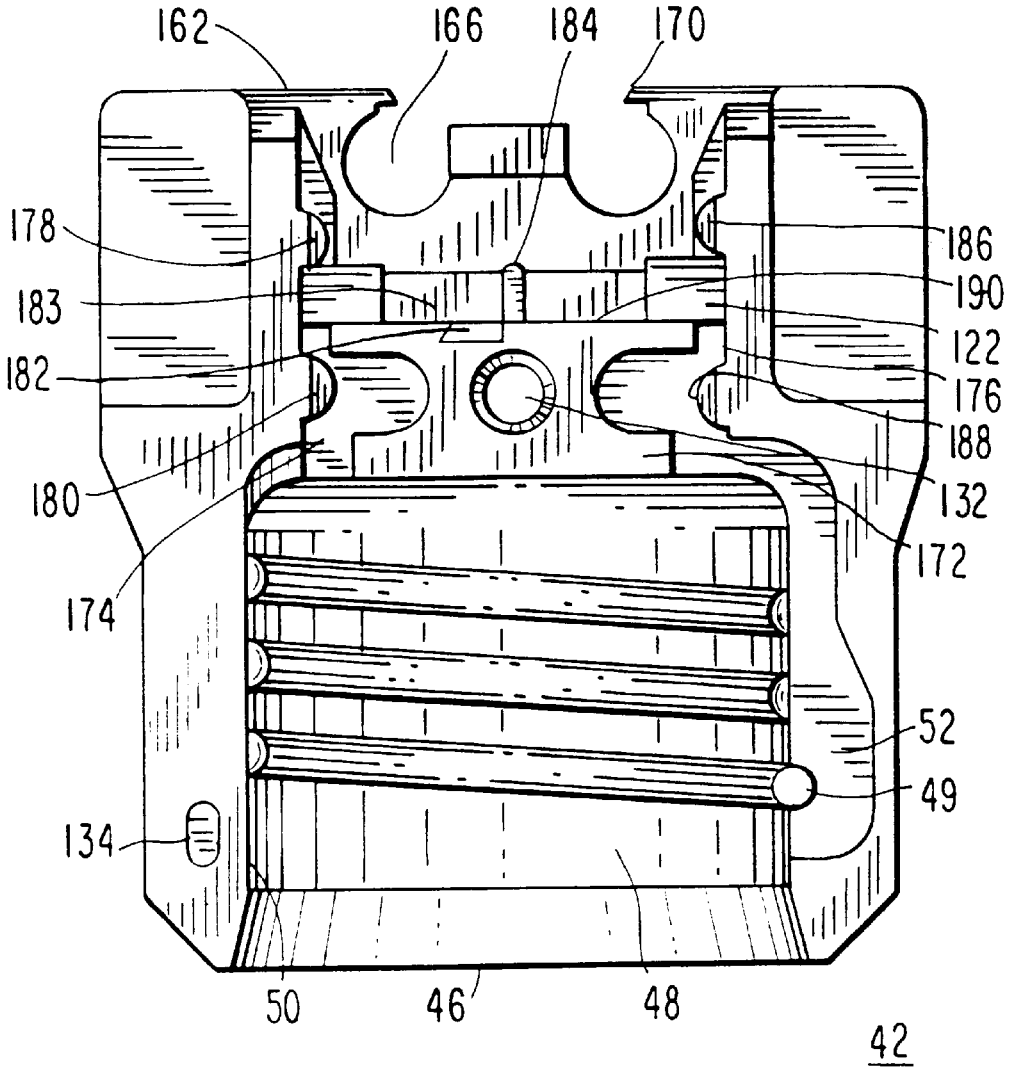
FIG. 8 is a front elevational view of the other half of the lampholder portion.

Lampholder portion 40 has a body made up of two mating halves 42, 44 which are nearly identical except for a small difference that will be described below. A snap-on cover 90 completes the snap-in lampholder assembly 20. The lampholder portion 40 can also be mounted in a metal panel (not shown) having a central circular aperture 28 with two opposed key slots 30 and the panel mounted to a ceiling, wall or other mounting surface. The interior of both mating halves 42 and 44, adjacent open end 46 comprises an internally screw threaded portion 48 dimensioned to receive a standard medium base lamp (not shown) see FIGS. 5 and 6. A lead-in for an inserted lamp is provided by the chamfered edge 50 about open end 46. A slot 52 extends in both halves 42, 44 to hold the shell contact 64. The ends 49 of the screw thread 48 adjacent open end 46 extend into slots 52 in both of the halves 42 and 44 to keep the shell contact 64 in position (see FIGS. 7 and 8).

Figure 4:
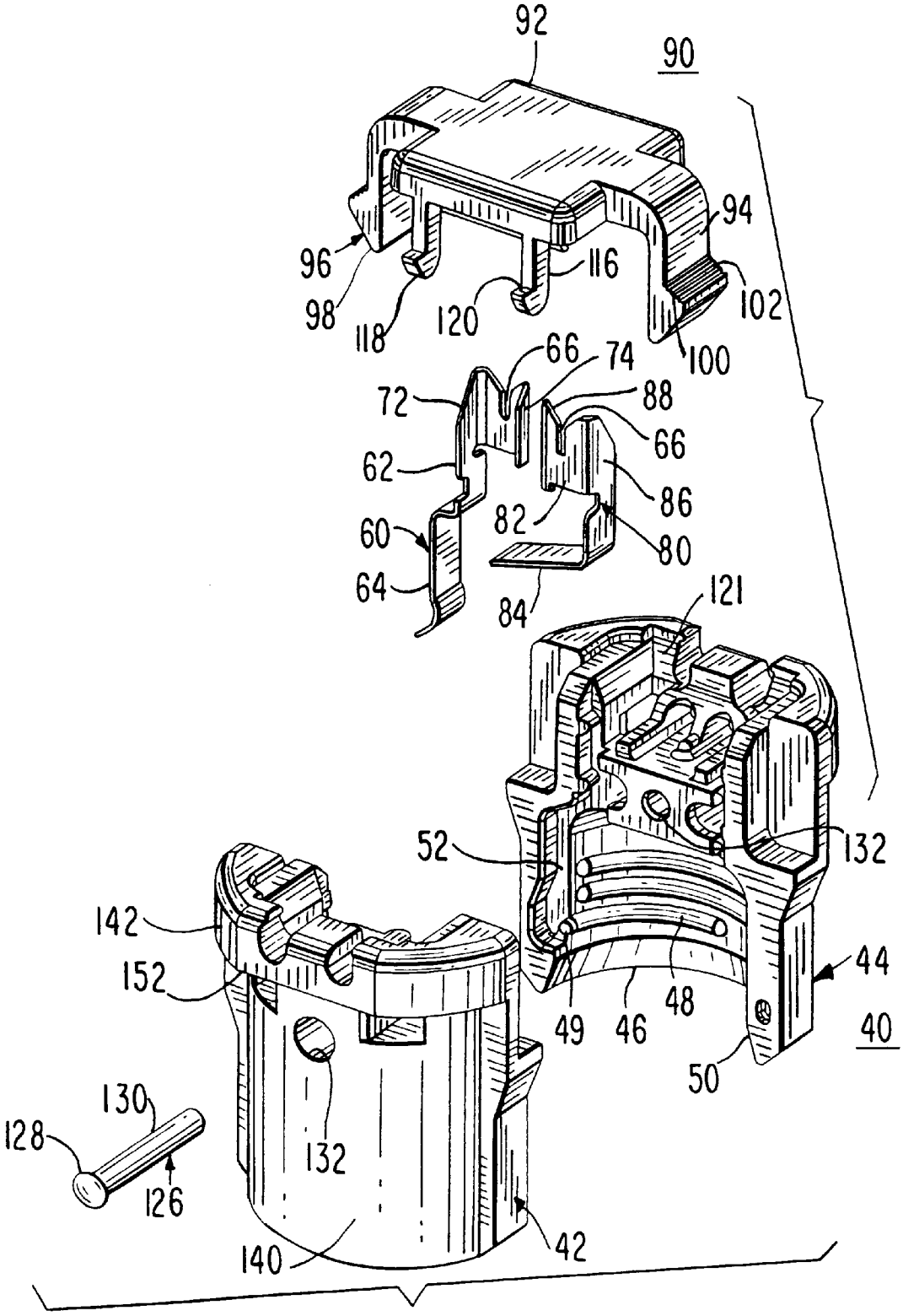
FIG. 4 is a fully exploded view of the lampholder portion as shown in FIG. 3.
Figure 6:
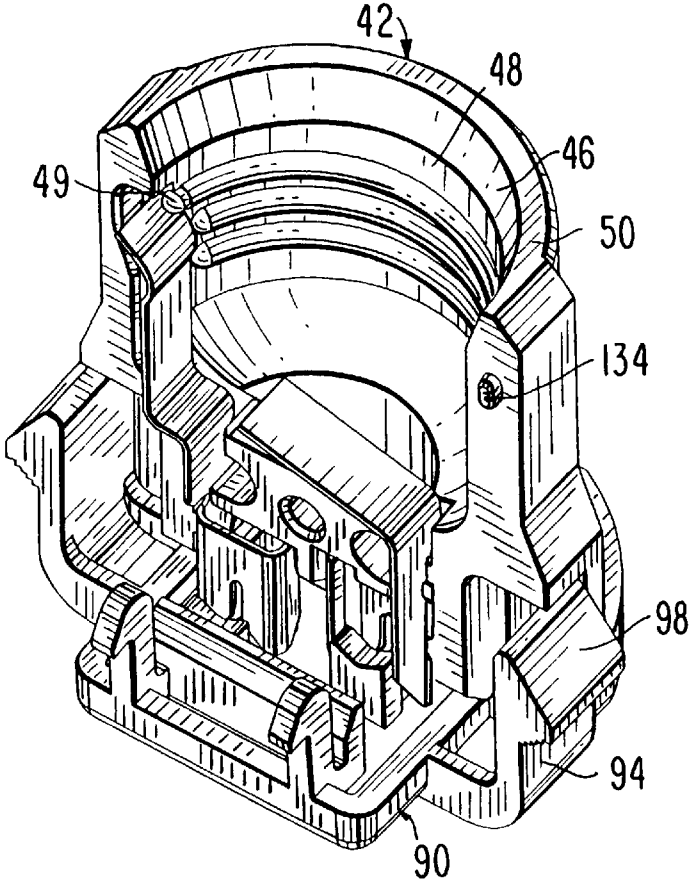
FIG. 6 is a front perspective view of a portion of the lampholder portion assembled and inverted with respect to FIG. 5.
Figure 5:
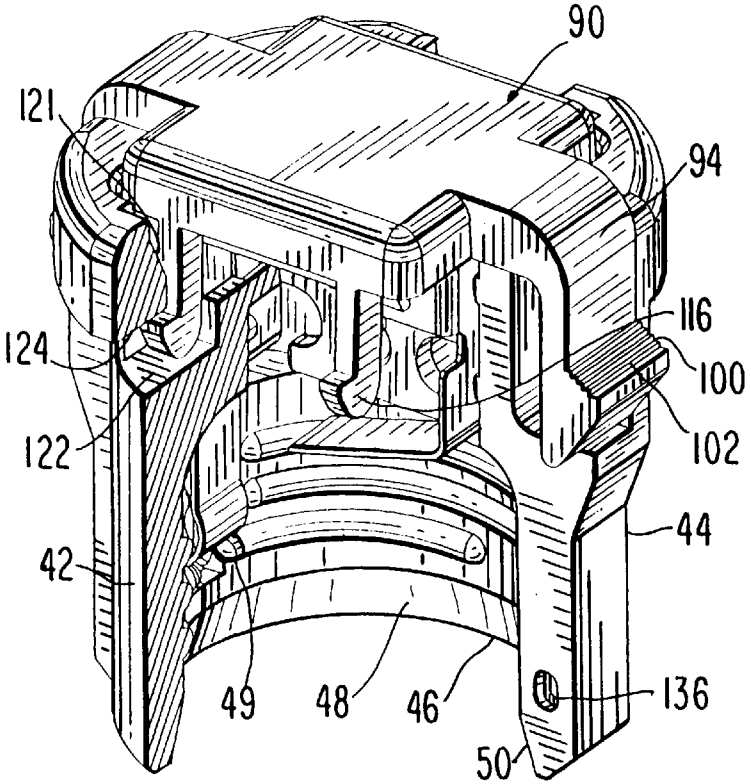
FIG. 5 is a front perspective view, partially in section, of the lampholder portion assembled.

As is shown in FIGS. 4, 5 and 6, a first IDC 60 has an upper body portion 62 and a shell contact 64. The upper body portion 62 is partially bifurcated to produce a slot 66 with sharp edges. The insulation of an insulated conductor 70 (see FIG. 9) is first pierced and then separated as the insulated conductor 70 is forced into the slot 66. The walls of slot 66 grip the central conductor (not shown) and make a good electrical and mechanical connection to such central conductor. The shell contact 64 extends within the adjoining slots 52 and under the ends 49 to hold the shell contact 64 in place where it can contact the screw shell base of a lamp threadably engaging screw threads 48. This connects one of the conductors 70 to one side of the inserted lamp filament (not shown). Side panels 72 and 74 provide additional strength to the upper body portion 62 and prevent deflecting the upper body portion 62 when a conductor 70 is forced into and along slot 66.

A second IDC 80 has an upper portion 82 bifurcated to produce a slot 66 into which an insulated conductor 70 is forced as was described above with respect to contact 60. IDC 80 terminates in a center base contact lever 84 which is cantilever mounted so that its free end extends into the threaded portion 48 to make contact with the central base contact of an inserted lamp (not shown). In this manner the second conductor 70 is connected to the other side of the lamp filament (not shown). Side panels 86, 88 provide additional strength to the upper body portion 82 and prevent deflecting the upper body portion 82 when a conductor 70 is forced into and along slot 66. The panels 86, 88 are directed in a direction opposite that of panels 72 and 74 and contacts 60 and 80 are offset so that the individual conductors 70 can be fully inserted into and along their respective slots 66 by pushing bars to be described below.

The mechanism for causing the conductors 70 to enter the slots 66 in the contacts 60 and 80 is the snap-on cover 90. Snap-on cover 90 has a central body portion 92 from which project two resilient arms 94. The lower portion 96 of the resilient arms 94 are outwardly tapered as at 98 so that the arms 94 can be deflected inwardly when the lampholder portion 40 is placed within central aperture 28 with the resilient arms 94, each in one of the opposed key slots 30. Above the outwardly tapered portion 98 is an inwardly tapered surface 100 having a plurality of steps 102. The different steps 102 engage the rear of the wall about the key slots 30 to accommodate different thicknesses of the mounting cup 22 or metal mounting panels. Two strain relief bars 104 and 106 are positioned to engage the conductors 70 before and after they enter the slots 66 of contacts 60 and 80 and thus prevent forces applied to the conductors 70 being transferred to the contacts 60, 80 or to the joints between the contacts 60, 80 and the conductors 70. The strain relief bars 104 and 106 are triangular in shape presenting a thin line of contact with the conductors 70. Pusher bars 108 and 110 are formed on the interior of central body portion 92 to push a conductor 70 into and along slot 66 of contact 60. The notched bottom surfaces of the pusher bars 108 and 110 tend to keep the conductor 70 centered and exert maximum force thereon. Pusher bars 112 and 114 are similar to pusher bars 108 and 110 but engage the other of the two conductors 70. Pusher bars 108, 110, 112 and 114 engage their respective conductors 70 to each side of contacts 60 and 80 so as not to injure the contacts 60, 80.

From the bottom of central body portion 92 on surfaces at 90° to resilient arms 94 are further resilient arms 116. Each of the resilient arms 116 has a tapered lead-in portion 118 and a locking surface 120. The resilient arms 116 are deflected inwardly towards the center of central body portion 92 as lead-in portion 118 traverses an inclined surface 121 (see FIGS. 4 and 5). Once the lead-in portions 118 are adjacent their associated locking apertures 122 (see FIG. 7), the resilient arms 116 are free to return to their original positions and place locking surfaces 120 in contact with the roof 124 of their associated locking apertures 122 (see FIG. 5).

The halves 42, 44 are joined by a rivet 126. The head portion 128 bears on half 42 while the rivet body 130 passes through corresponding apertures 132 in the halves 42, 44. The end of the rivet body 130 is upset adjacent the outer surface of the half 44 to lock the halves 42, 44 together. The rivet 126 could also be assembled from half 44 to half 42. A positioning tab 134 on half 42 enters a corresponding recess 136 on half 44 for assembly.

Figure 1:
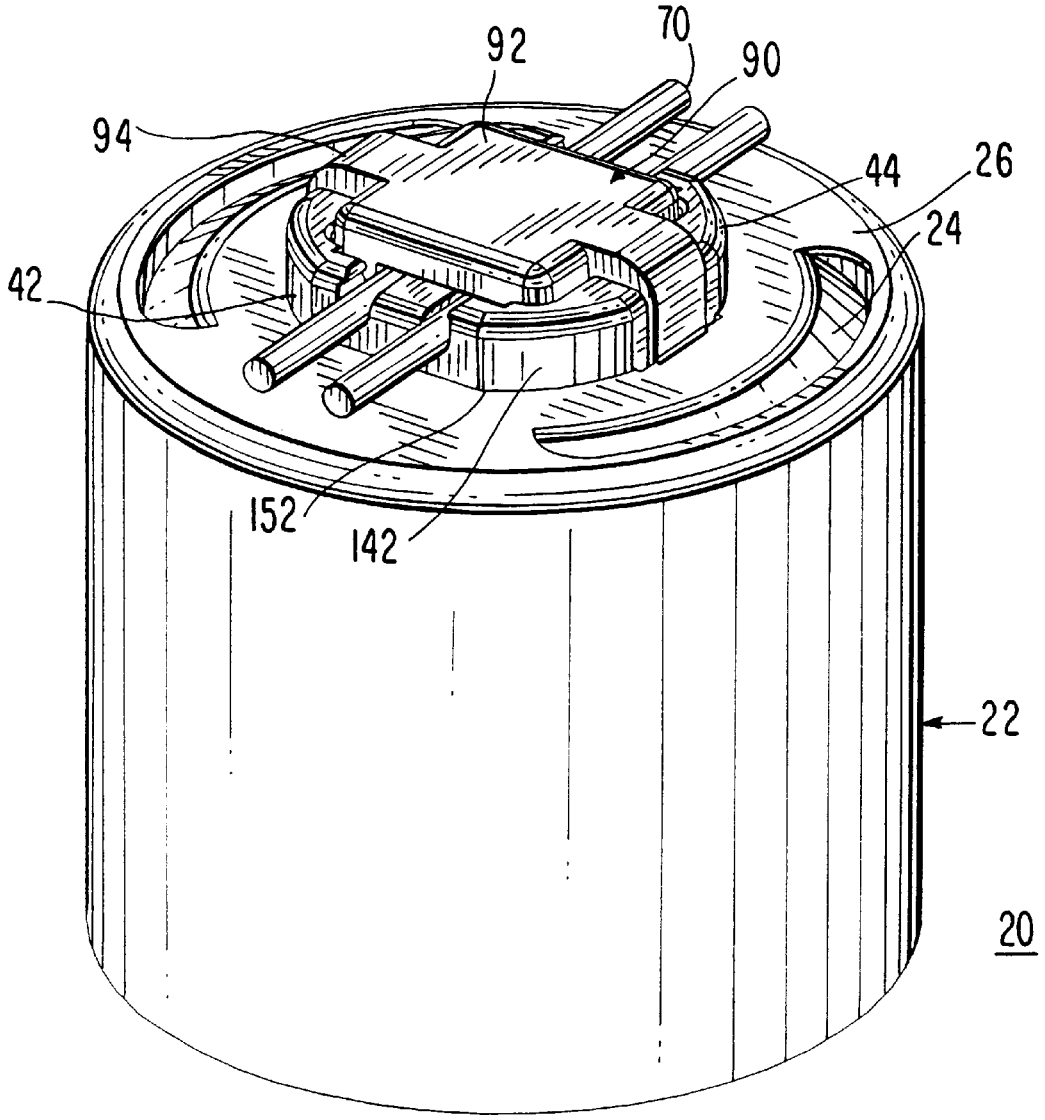
FIG. 1 is a front perspective view of a snap-in lampholder assembly constructed in accordance with the concepts of the invention and mounted upon a mounting cup.
Figure 2:
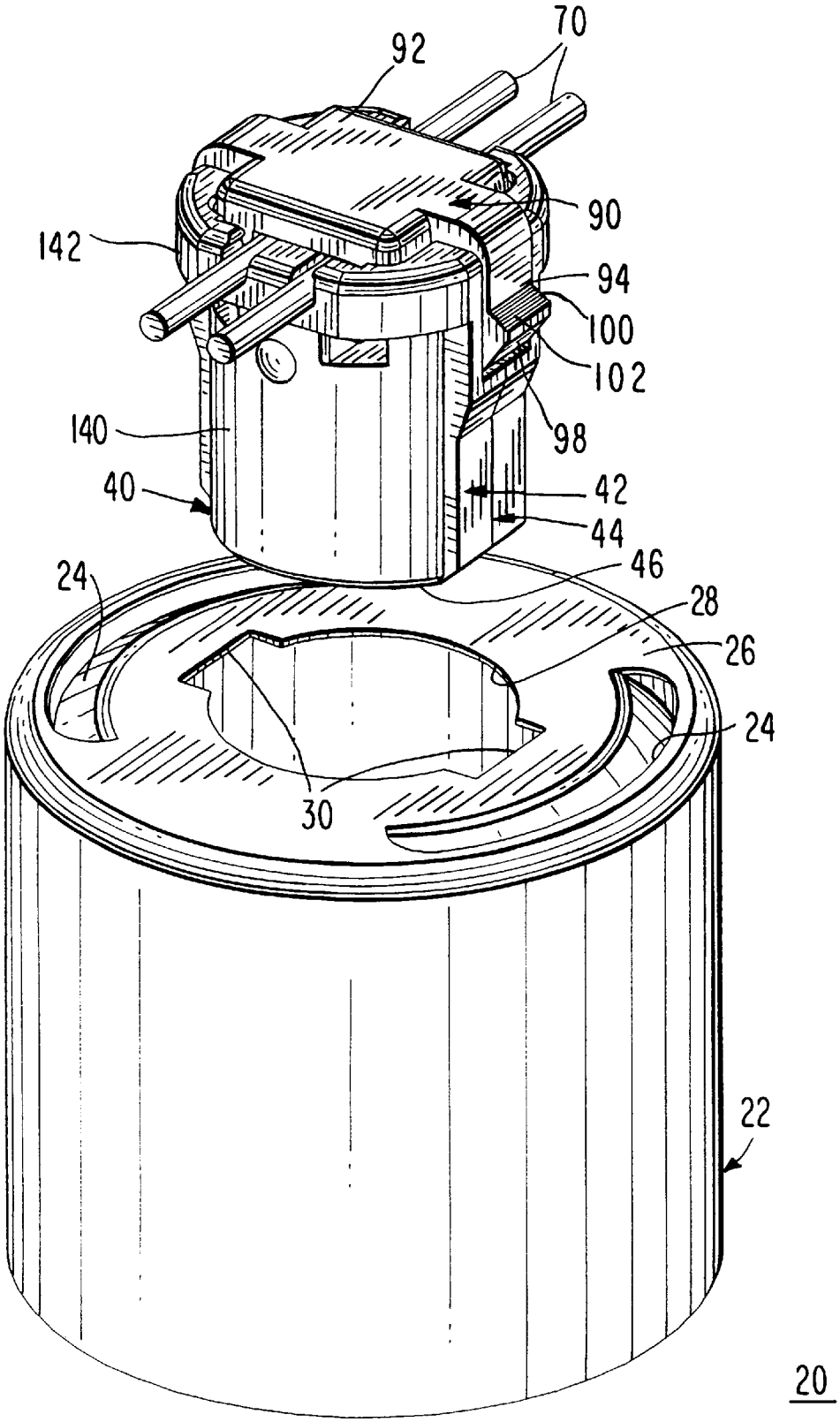
FIG. 2 is a partially exploded view of the snap-in lampholder assembly of FIG. 1.
Figure 3:
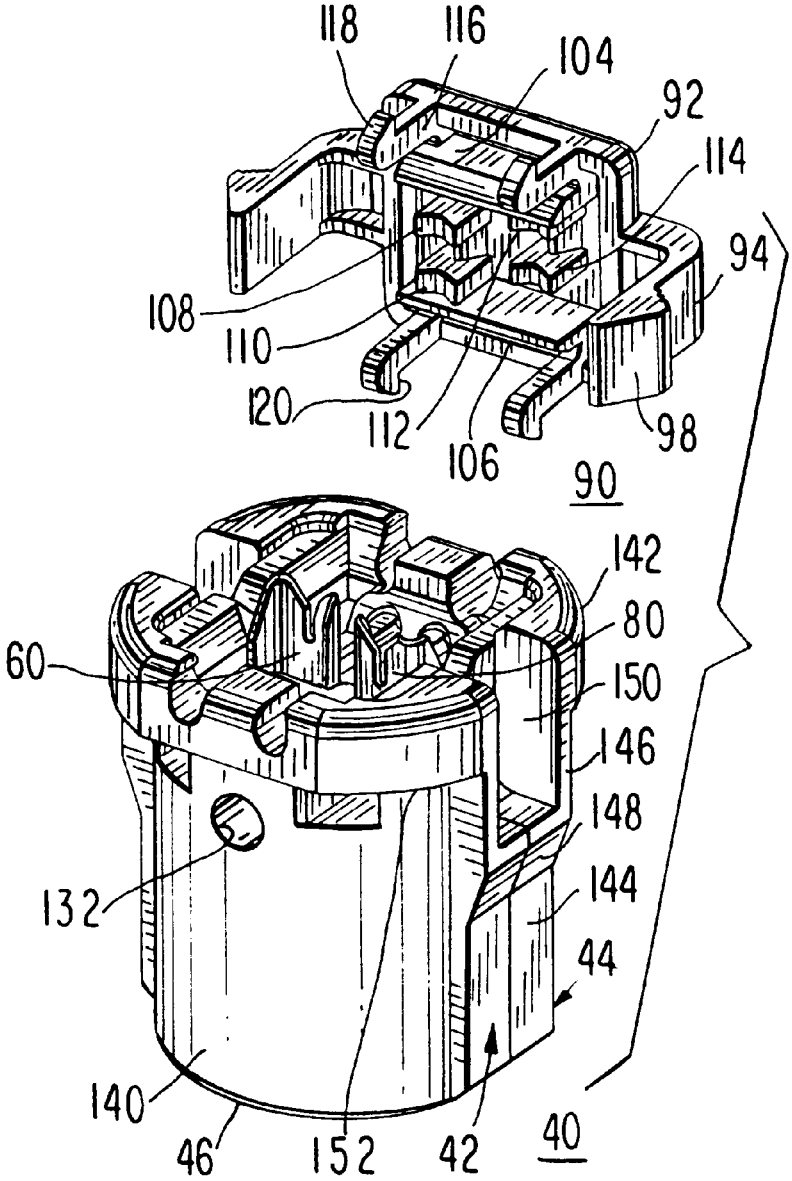
FIG. 3 is a partially exploded view of the major components of the lampholder portion of the assembly of FIG. 1.

Turning now to FIG. 3, the lampholder 40 has a cylindrical outer surface 140 and an annular ring 142 at the end remote from the open end 46. A two step shoulder, having a lower portion 144 and an upper portion 146 with a tapered step 148 therebetween extends from ring 142. Lower portions 144 and steps 148 are solid but the upper portions 146 each contain a chamber 150. Chambers 150 are positioned at positions 90° from the direction of the conductors 70 through contacts 60, 80 and receive the resilient arms 94 of snap-on cover 90. The lower portion 144 and the upper portion 146 of each of the shoulders fits within a key slot 30 while the remainder of the cylindrical outer surface 140 fits within the central circular aperture 28 with the lower edge 152 of the annular ring 142 resting on the top surface 26 as can be seen in FIG. 1.

Figure 9:
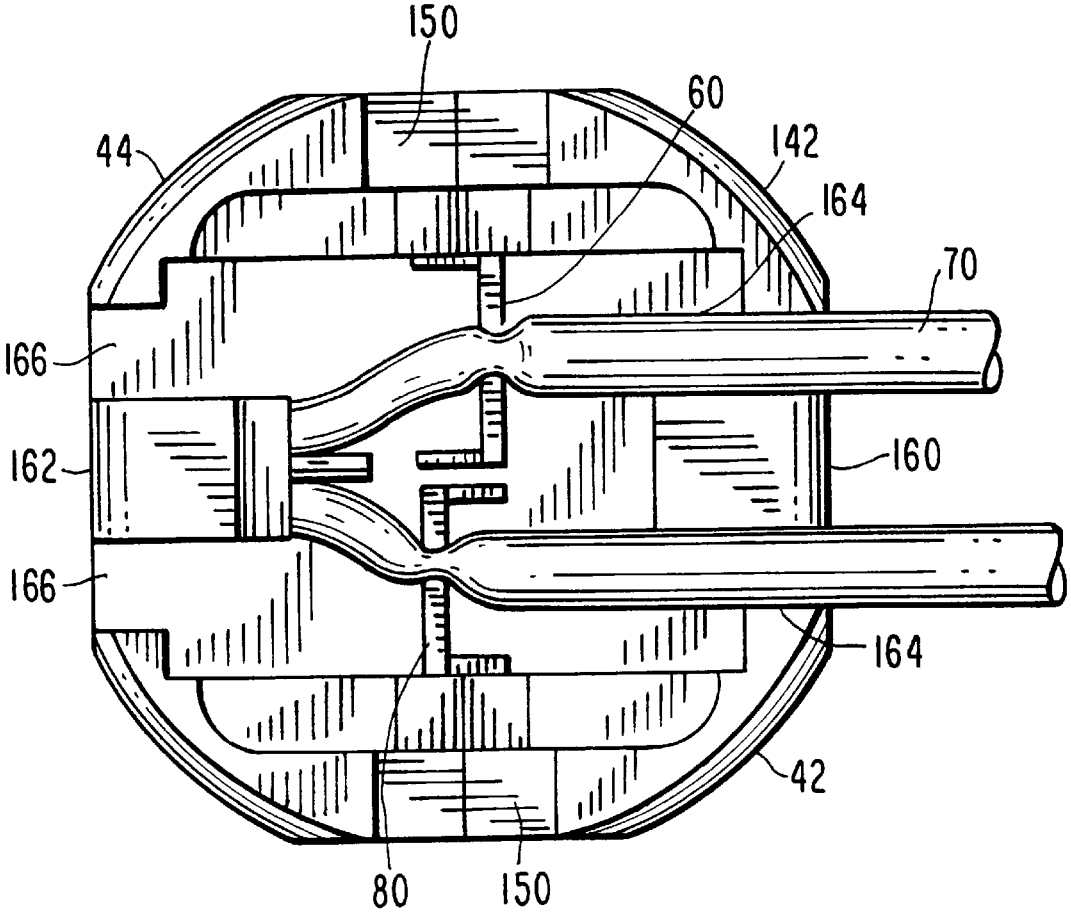
FIG. 9 is a top plan view of the lampholder portion, without the snap-on cover and engaging electrical conductors.

The annular ring 142 has two flattened portions 160, 162 generally in line with the contacts 60, 80 (see FIG. 9). Two apertures 164 extend through portion 160 and two more apertures 166 extend through portion 162 (see FIGS. 7, 8 and 9). The apertures 164 and 166 are generally U-shaped and have an inwardly extending lip 168, 170, respectively. The extending lips 168 and 170 aid in the assembly of conductors 70 to lampholder 40.

As set forth above the lampholder 40 has an internally threaded area 48 to threadably engage the externally threaded screwshell of a medium base lamp (not shown). Above the end of the threaded area 48 is a strengthening rib 172 having an aperture 132 through it. The apertures 132 in half 42 and 44 are aligned so that rivet 126 can pass through as set forth above. Passages 174 and 176 separate the rib 172 ends from the side walls of the halves 42, 44 and enter the internally threaded area 48. The IDC 80 extends through passage 174 into the area 48 where it can engage the center base contact of an inserted lamp (not shown) to complete the circuit for such lamp. The IDC 60 extends through passage 176 into slots 52 and under end 49.

A set of ribs 178, 180 extend into passage 174 passage to position contact 80 in the passage 174. A slot 182 and a ledge 183 receive a portion of the upper portion 82 to limit movement of IDC 80 into the lamp holder 40. A rib 184 limits lateral movement of IDC 80. Passage 176 has two positioning ribs 186, 188 to engage IDC 60 and hold it in position in the passage 176. Rib 184 also prevents lateral movement of IDC 60 and ledge 190 limits movement of the IDC 60 into the lampholder 40.

Two locking apertures 122 are adjacent the end of inclined surface 121 to lock the snap-on cover 90 to the lampholder 40, as described above.

For a midspan installation, the two conductors 70 of a cord are separated in the region of the lampholder 40. One conductor 70 passes through aperture 164 in flattened portion 160, over IDC 80 and out an aperture 166 in flattened portion 162. The second conductor 70 follows a similar path but passes over IDC 60. When the central body portion 92 is depressed one conductor 70 is forced into slot 66 of IDC 80 and the other conductor 70 is forced into slot 66 of IDC 60 to make mechanical and electrical contact with the conductors 70.

For installation of lampholder 40 to the end of an electrical cord half 44 has a pair of bores 200 and three upstanding ribs 202, 204 and 206. To install the lampholder 40 to the conductors 70 of a dual conductor electrical cord, the two conductors 70 are separated and the end of one conductor 70 is positioned between ribs 202 and 204 and into a bore 200. The other conductor 70 is positioned between ribs 204 and 206 and into the other bore 200. In this way there is no exposed wire and the conductors 70 are fixed in position. The depression of central body portion 92 completes the installation of the conductors 70 in the IDCS 60, 80.

While there have been shown and described and pointed out the fundamental novel features of the invention as applied to the preferred embodiment, as presently contemplated for carrying them out, it will be understood that various omissions and substitutions and changes of the form and details of the device illustrated and in its operation may be made by those skilled in the art, without departing from the spirit of the invention.

I claim:

1. A snap-in lampholder assembly for connection to the two electrical conductors of a two conductor electrical cord comprising:

a) a lampholder body having a first end and a second end, said lampholder body having a lamp receiving cavity adjacent said first end and a conductor receiving cavity adjacent said second end;

b) said conductor-receiving cavity having two contacts, one for each of said two electrical conductors;

c) said lampholder body further having a first vertical wall and an annular ring at said second end;

d) said conductor receiving cavity being bounded by said annular ring and having four locking apertures in said first vertical wall;

e) a cover member having a front edge, a rear edge and two parallel lateral side edges extending between said front and rear edges to define a rectangular shape and having four locking arms, two of said four arms at each of said front and rear edges, one locking arm for each of said four locking apertures, for positioning over said conductor receiving cavity;

f) said cover member when depressed towards said conductor receiving cavity forcing each of said two electrical conductors into engagement with a respective one of said two contacts and locking said cover member to said lampholder body by engaging each of said four locking arms in an associated one of said four locking apertures.

2. A snap-in lampholder assembly, as defined in claim 1, further comprising:

a) two resilient arms, each extending from one of said two parallel lateral side edges of said cover member;

b) said resilient arms each having a free end; and c) a mounting tab at the free end of each of said two resilient arms, each having a tapered leading edge and a locking surface.

3. A snap-in lampholder assembly, as defined in claim 2, wherein each of said locking surfaces has at least two steps thereon whereby said snap-in lampholder may be assembled to mounting panels having different thicknesses.

4. A snap-in lampholder, as defined in claim 2, wherein an exterior of said first vertical wall and said annular ring have two recesses, one for each of said resilient arms into which said associated resilient arms may be deflected as said lampholder assembly is inserted into an aperture in a mounting panel.

5. A snap-in lampholder, as defined in claim 1, further comprising:

a) two insulation displacement contacts, one for each of said two electrical conductors of a two conductor electrical cord, each having a first end and a second end; said first end of said contacts having an insulation displacement slot and said second end terminating in a lamp contact;

b) a first of said two insulation displacement contacts receiving in an insulation displacement slot, a first of said two electrical conductors to establish a mechanical and electrical connection between said insulation displacement contact and said first of said two electrical conductors; said lamp contact of said first insulation displacement contact extending into said lamp receiving cavity to engage the screwshell of a lamp inserted into said lamp receiving cavity; and c) the second of said two insulation displacement contacts receiving in an insulation displacement slot, a second of said two electrical conductors to establish a mechanical and electrical connection between said insulation displacement contact and said second of said two electrical conductors; said lamp contact of said second insulation displacement contact extending into said lamp receiving cavity to engage the central base contact of a lamp inserted into said lamp receiving cavity.

6. A snap-in lampholder, as defined in claim 1, further comprising:

a) said cover member having generally parallel, spaced apart top and bottom surfaces; and b) a strain relief bar extending from said bottom surface adjacent to one of said front edge and said rear edge to engage said two electrical conductors when said cover member is depressed to prevent damage to said two contacts and the joint between each of said two contacts and their associated electrical conductors.

7. A snap-in lampholder, as defined in claim 1, further comprising:

a) said cover member having generally parallel, spaced apart top and bottom surfaces; and b) two strain relief bars extending from said bottom surface, one strain relief bar adjacent said front edge and a second strain relief bar adjacent said rear edge to engage said two electrical conductors when said cover member is depressed to prevent damage to said two contacts and the joint between each of said two contacts and the joint between each of said two contacts and their associated electrical conductor.

8. A snap-in lampholder, as defined in claim 1, further comprising:

a) said cover member having generally parallel, spaced apart top and bottom surfaces;

b) first pusher means extending from said bottom surface to force a first electrical conductor into an associated first contact insulation displacement slot; and c) a second pusher means extending from said bottom surface to force a second electrical conductor into an associated second contact insulation displacement slot.

9. A snap-in lampholder, as defined in claim 8, wherein:

a) said first pusher means is two pusher bars, one to each side of said first insulation displacement contact whereby an electrical conductor to be forced into and along said insulation displacement slot is uniformly urged against said first contact; and b) said second pusher means is two pusher bars, one to each side of said second insulation displacement contact whereby an electrical conductor to be forced into and along said insulation displacement slot is uniformly urged against said second contact.

10. A snap-in lampholder, as defined in claim 1, wherein said two contacts are staggered with respect to one another.

11. A snap-in lampholder, as defined in claim 1, wherein said annular ring has two first apertures at an entrance to said conductor receiving cavity and two second apertures at an exit from said conductor receiving cavity whereby two electrical conductors can extend through said conductor receiving cavity from said first apertures to said second apertures and within said conductor receiving cavity said conductors can be coupled to associated contacts.

12. A snap-in lampholder, as defined in claim 1, wherein:

a) said annular ring has two apertures at an entrance to said conductor receiving cavity;

b) two bores in said annular ring opposite said two apertures, each of said bores adapted to receive the end of one of said two electrical conductors whereby two electrical conductors can extend within said conductor receiving cavity from said two apertures to said two bores and within said conductor receiving cavity said conductors can be coupled to associated contacts.

13. A snap-in lampholder, as defined in claim 1, further comprising:

a) said lamp receiving cavity is bounded by a partial cylindrical second wall;

b) at least one shoulder on an outer surface of said second wall parallel with and extending radially outwardly from a central longitudinal axis whereby said lampholder can be placed in a circular aperture with a radial slot extending therefrom to aid in assembly of said lampholder to a metal panel and prevent its rotation during insertion or removal of a lamp into or out of said lamp receiving cavity.

* * * * *